US010410586B2

(12) United States Patent
Ahn et al.

(10) Patent No.: US 10,410,586 B2
(45) Date of Patent: Sep. 10, 2019

(54) DISPLAY DEVICE INCLUDING TIMING CONTROLLER AND DUPLEX COMMUNICATION METHOD OF THE SAME

(71) Applicant: Samsung Display Co., Ltd., Yongin-Si, Gyeonggi-Do (KR)

(72) Inventors: Heesun Ahn, Suwon-si (KR); Kyungyoul Min, Hwaseong-si (KR); Junyong Song, Hwaseong-si (KR); Donggyu Lee, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 504 days.

(21) Appl. No.: 15/195,224

(22) Filed: Jun. 28, 2016

(65) Prior Publication Data

US 2017/0124957 A1 May 4, 2017

(30) Foreign Application Priority Data

Oct. 30, 2015 (KR) ..... 10-2015-0151536

(51) Int. Cl.

| | |
|---|---|
| ***G09G 3/3233*** | (2016.01) |
| ***G09G 3/325*** | (2016.01) |
| ***G09G 3/3258*** | (2016.01) |
| ***G09G 3/3266*** | (2016.01) |
| ***G09G 3/3291*** | (2016.01) |

(52) U.S. Cl.

CPC ..... *G09G 3/3291* (2013.01); *G09G 3/325* (2013.01); *G09G 3/3233* (2013.01); *G09G 3/3258* (2013.01); *G09G 3/3266* (2013.01); *G09G 2300/0417* (2013.01); *G09G 2300/0809* (2013.01); *G09G 2300/0819* (2013.01); *G09G 2310/0291* (2013.01); *G09G 2320/029* (2013.01); *G09G 2320/0257* (2013.01); *G09G 2370/08* (2013.01); *G09G 2370/12* (2013.01)

(58) Field of Classification Search

None

See application file for complete search history.

(56) References Cited

U.S. PATENT DOCUMENTS

| | | | | |
|---|---|---|---|---|
| 9,520,087 | B2 * | 12/2016 | Park | G09G 3/3233 |
| 9,646,533 | B2 * | 5/2017 | Hong | G09G 3/3233 |
| 9,705,502 | B2 * | 7/2017 | Wang | H03K 5/125 |
| 9,754,536 | B2 * | 9/2017 | Chang | G09G 3/3258 |
| 9,972,246 | B2 * | 5/2018 | Park | G09G 3/3258 |

(Continued)

FOREIGN PATENT DOCUMENTS

| | | | |
|---|---|---|---|
| KR | 100487471 | B1 | 4/2005 |
| KR | 100587473 | B1 | 5/2006 |

(Continued)

*Primary Examiner* — Chanh D Nguyen
*Assistant Examiner* — Karin Kiyabu
(74) *Attorney, Agent, or Firm* — Cantor Colburn LLP

(57) ABSTRACT

A display device includes a timing controller which transmits an image control signal and at a same time receive a feedback signal, a source driver which transmits the feedback signal and receive the image control signal, and a duplex communication path between the timing controller and the source driver, where the timing controller detects a voltage level of a signal received through the duplex communication path and recovers the feedback signal according to the detected voltage level.

12 Claims, 7 Drawing Sheets

(56) References Cited

U.S. PATENT DOCUMENTS

2005/0179625 A1* 8/2005 Choi ..... G09G 3/3233 345/76
2009/0027010 A1* 1/2009 Ha ..... H02J 7/0044 320/138
2009/0122003 A1* 5/2009 Chen ..... G09G 3/3406 345/102
2009/0309818 A1* 12/2009 Kim ..... G09G 3/3233 345/77
2010/0045655 A1* 2/2010 Jang ..... G09G 3/20 345/213
2010/0215130 A1* 8/2010 Hsiao ..... G09G 5/006 375/340
2011/0090261 A1* 4/2011 Kang ..... H05B 33/0848 345/690
2011/0187405 A1* 8/2011 Bolz ..... H04L 5/16 326/30
2013/0113777 A1* 5/2013 Baek ..... G09G 3/20 345/212
2013/0147694 A1* 6/2013 Kim ..... G09G 3/32 345/82
2013/0162617 A1* 6/2013 Yoon ..... G09G 3/3291 345/211
2014/0078133 A1* 3/2014 Lee ..... G09G 3/2092 345/213
2014/0176525 A1* 6/2014 Woo ..... G09G 3/3233 345/212
2015/0061981 A1* 3/2015 Lee ..... G09G 3/3291 345/77
2016/0094226 A1* 3/2016 Wang ..... H03K 5/125 307/130
2017/0110040 A1* 4/2017 Shimizu ..... G09G 3/2092
2017/0277249 A1* 9/2017 Low ..... G06F 1/3293
2019/0066594 A1* 2/2019 Lee ..... G09G 3/3258

FOREIGN PATENT DOCUMENTS

KR 100744116 B1 7/2007
KR 101057518 B1 8/2011
KR 1020130044567 A 5/2013
KR 1020150064803 A 6/2015

* cited by examiner

DISPLAY DEVICE INCLUDING TIMING CONTROLLER AND DUPLEX COMMUNICATION METHOD OF THE SAME

This application claims priority to Korean Patent Application No. 10-2015-0151536, filed on Oct. 30, 2015, and all the benefits accruing therefrom under 35 U.S.C. § 119, the content of which in its entirety is herein incorporated by reference.

BACKGROUND

1. Field

Exemplary embodiments of the invention herein relate to a display device including a timing controller.

2. Description of the Related Art

Typically, a display device includes a display panel for displaying an image and a driving circuit driving the display panel. The display panel includes a plurality of gate lines, a plurality of data lines, and a plurality of pixels. Each of the plurality of pixels includes a thin film transistor ("TFT"), a liquid crystal capacitor, and a storage capacitor. A driving circuit includes a source driver for outputting a data driving signal to the data lines, a gate driver for outputting a gate driving signal for driving the gate lines, and a timing controller for controlling the source driver and the gate driver.

Such a display device may apply a gate-on voltage to a gate electrode of a TFT connected to a gate line corresponding to an image area, and then apply a data voltage corresponding to a display image to a source electrode of the TFT to display the image.

SUMMARY

A timing controller provides an image signal and a control signal, but there has not been a signal provided from a source driver to the timing controller. As features of a display device become diversified, it is desired to provide an information signal from the source driver to the timing controller.

Exemplary embodiments of the invention provide a display device in which duplex communication is enabled between a timing controller and a source driver.

Exemplary embodiments of the invention also provide a communication method of a timing controller capable of performing duplex communication with a source driver.

An exemplary embodiment of the invention provides a display device including a timing controller which transmits an image control signal and at a same time receive a feedback signal, a source driver which transmits the feedback signal and receive the image control signal, and a duplex communication path between the timing controller and the source driver. The timing controller may detect a voltage level of a signal received through the duplex communication path and recover the feedback signal according to the detected voltage level.

In an exemplary embodiment, the timing controller may include a control unit which receives an image signal and a control signal from an outside, and to output the image control signal, a transmitter which transmits the image control signal to the duplex communication path, and a reception circuit which recovers the feedback signal according to the detected voltage level.

In an exemplary embodiment, the duplex communication path may include first and second signal lines for differential signal transmission.

In an exemplary embodiment, the reception circuit may include a voltage detector which is connected to the first and second signal lines, and detects voltage levels of signals received through the first and second signal lines, and a receiver which recovers the feedback signal according to the detected voltage levels.

In an exemplary embodiment, the reception circuit may include a voltage detector including a plurality of resistors connected between the first and second signal lines, and a receiver which compares a voltage of a first node between the plurality of resistors and a threshold voltage, and recovers the feedback signal according to a compared result.

In an exemplary embodiment, the receiver may recover the feedback signal into a first voltage level when the voltage of the first node has a higher level than that of the threshold voltage, and may recover the feedback signal into a second voltage level when the voltage of the first node has a lower level than that of the threshold voltage.

In an exemplary embodiment, the source driver may include a receiver which receives the image control signal through the duplex communication path, a source driving unit which drives a plurality of data lines in response to the image control signal received through the receiver, and to output the feedback signal, and a transmission circuit which transmits the feedback signal to the duplex communication path.

In an exemplary embodiment, the transmission circuit may include a transmitter which transmits the feedback signal to the duplex communication path, and a termination resistor circuit connected between an output terminal of the transmitter and the duplex communication path.

In an exemplary embodiment, the display device may further include a display panel including a plurality of pixels respectively connected to a plurality of gate lines and a plurality of data lines, and a gate driver which drives the plurality of gate lines. The source driver may drive the plurality of data lines in response to the image control signal.

In an exemplary embodiment of the invention, a duplex communication method of a timing controller includes transmitting an image control signal to a source driver through a duplex communication path, detecting a voltage level of a signal received through the duplex communication path, and recovering a feedback signal transmitted from the source driver according to the detected voltage level.

In an exemplary embodiment, the duplex communication path may be connected to first and second signal lines, and the detecting of the voltage level may include detecting voltage levels of signals received through the first and second signal lines.

In an exemplary embodiment, the detecting of the voltage level may include comparing the detected voltage level with a threshold voltage, recovering the feedback signal into a first voltage level, when the detected voltage level is higher than the threshold voltage, and recovering the feedback signal into a second voltage level, when the detected voltage level is lower than the threshold voltage.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
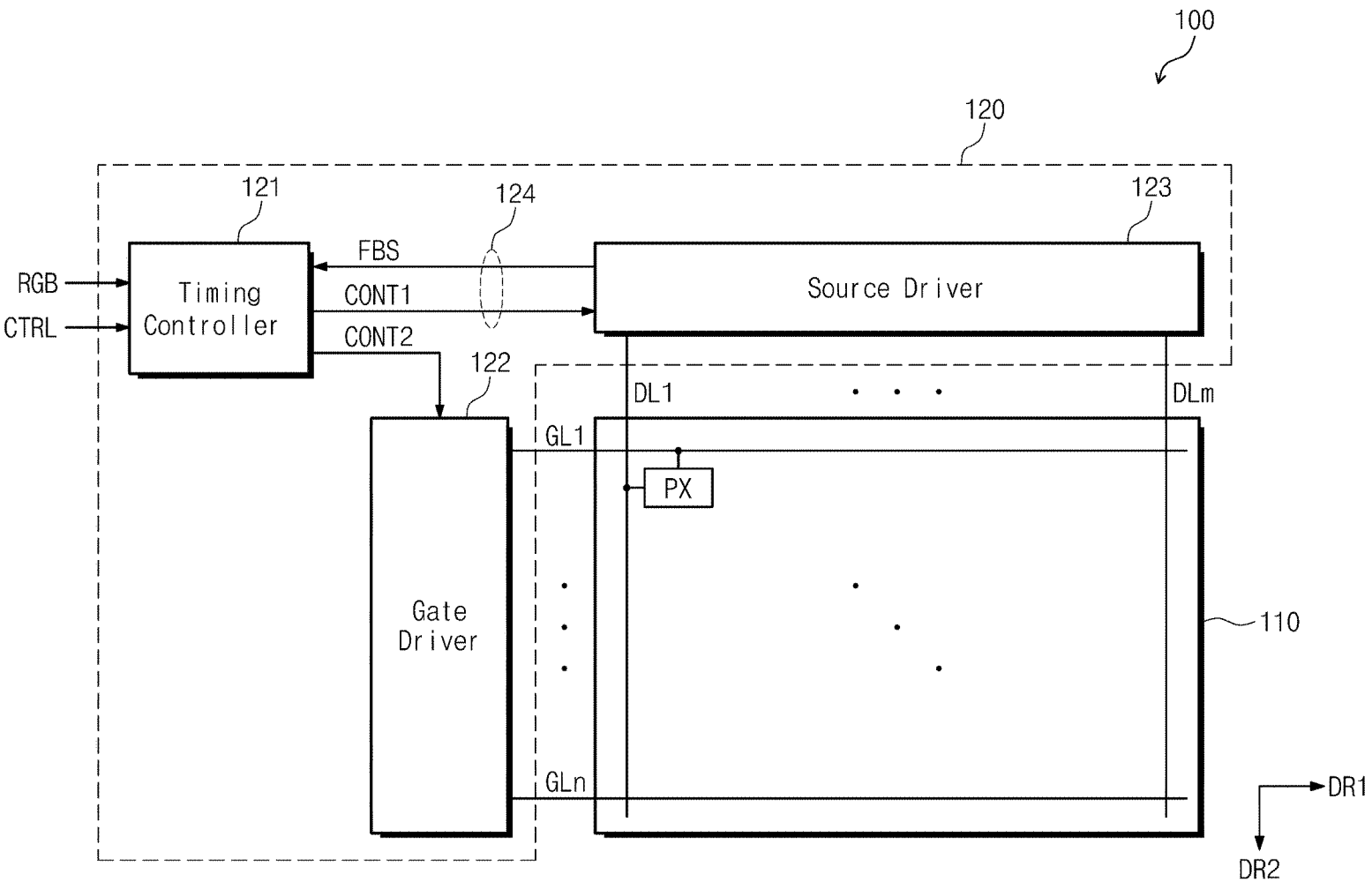
FIG. 1 is a block diagram illustrating an exemplary embodiment of a configuration of a display device according to the invention.

Exemplary embodiments of the invention will be described below in more detail with reference to the accompanying drawings. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating a configuration of a display device according to an exemplary embodiment of the invention.

Referring to FIG. 1, a display device 100 includes a display panel 110 and a driving circuit 120. The driving circuit 120 includes a timing controller 121, a gate driver 122, and a source driver 123.

The display panel 110 includes a plurality of data lines DL1 to DLm, and a plurality of gate lines GL1 to GLn intersected with the plurality of data lines DL1 to DLm, and a plurality of pixels PX arrayed on the intersection regions thereof. The plurality of gate lines GL1 to GLn extends in a first direction DR1 from the gate driver 122 and are sequentially arrayed in a second direction DR2. The plurality of data lines DL1 to DLm extends in the second direction DR2 from the source driver 123 and is sequentially arrayed in the first direction DR1. The plurality of data lines DL1 to DLm and the plurality of gate lines GL1 to GLn are insulated from each other.

Even though not shown in the drawing, each of the plurality of pixels PX may include a switching transistor connected to a corresponding data line and gate line, a liquid crystal capacitor connected thereto and a storage capacitor.

The timing controller 121 receives an image signal RGB and a control signal CTRL provided from the outside. The timing controller 121 provides an image control signal CONT1 to the source driver 123 and a gate control signal CONT2 to the gate driver 122. The timing controller 121 provides the image control signal CONT1 serialized in a clock embedded interface manner to the source driver 123. The image control signal CONT1 includes a data signal and a clock signal. In an exemplary embodiment, the image control signal CONT1 may further include a polarization control signal and a load signal.

The source driver 123 drives the plurality of data lines DL1 to DLm in response to the image control signal CONT1 from the timing controller 130. The source driver 123 may be implemented into an independent integrated circuit and may be electrically connected to one side of the display panel 110 or directly disposed (e.g., mounted) on the display panel 110. In addition, the source driver 123 may be implemented into a single chip or may include a plurality of chips.

The gate driver 122 drives the plurality of gate lines GL1 to GLn in response to the gate control signal CONT2 from the timing controller 121. The gate driver 122 may be implemented into an independent integrated chip and may be electrically connected to one side of the display panel 110. In an exemplary embodiment, the gate driver 122 may be implemented into a circuit having an amorphous silicon gate ("ASG") using amorphous silicon TFT ("a-Si TFT"), or a circuit using an oxide semiconductor, a crystalline semiconductor, and a polycrystalline semiconductor, for example, and may be implemented at a predetermined region on the display panel 110. In another exemplary embodiment, the gate driver 122 may be implemented with a tape carrier package ("TCP") or a chip on film ("COF"), for example.

While a gate-on voltage is applied to one gate line, respective switching transistors in a row of pixels, which are connected to the one gate line, may be turned on. At this point, the source driver 123 provides data driving signals corresponding to the data signals included in the image control signal CONT1 to the data lines DL1 to DLm. The data driving signals provided to the data lines DL1 to DLm are applied to corresponding pixels through the turned-on switching transistors.

In an exemplary embodiment, it is assumed that the display device 100 is an organic light emitting display device, for example. In this point, the thin-film transistor provided in the display panel 110 may increase mobility therein by means of a semiconductor layer, which is provided with polysilicon through crystallization of amorphous silicon, to be driven in a high speed. However, such a TFT has a limitation of hysteresis. In other words, a hysteresis phenomenon occurs in a case where gate-source voltage versus drain current curves get differed when a gate voltage of a transistor is changed from a low voltage to a high voltage or from a high voltage to a low voltage. Typically, due to such a hysteresis, the threshold voltage of the transistor may be changed, and accordingly a residual image may occur.

One of methods for addressing the limitation of hysteresis is to provide a predetermined data signal to pixels PX of the display panel 110 and to provide pixel characteristic information on the data signal to the timing controller 121. The timing controller 121 may provide a data signal compensated on the basis of the pixel characteristic information to prevent a residual image caused by the hysteresis.

In this way, the pixel characteristic information provided from the display panel 110 to the source driver 123 or various information generated from the source driver 123 are to be provided to the timing controller 121. However, equipping with separate interconnections and input/output terminals for providing the information from the source driver 123 to the timing controller 121 causes a cost increase.

In the example illustrated in FIG. 1, the image control signal CONT1 provided from the timing controller 121 to the source driver 123 and a feedback signal FBS provided from the source driver 123 to the timing controller 121 may be simultaneously transmitted through the duplex communication path 124.

Figure 2:
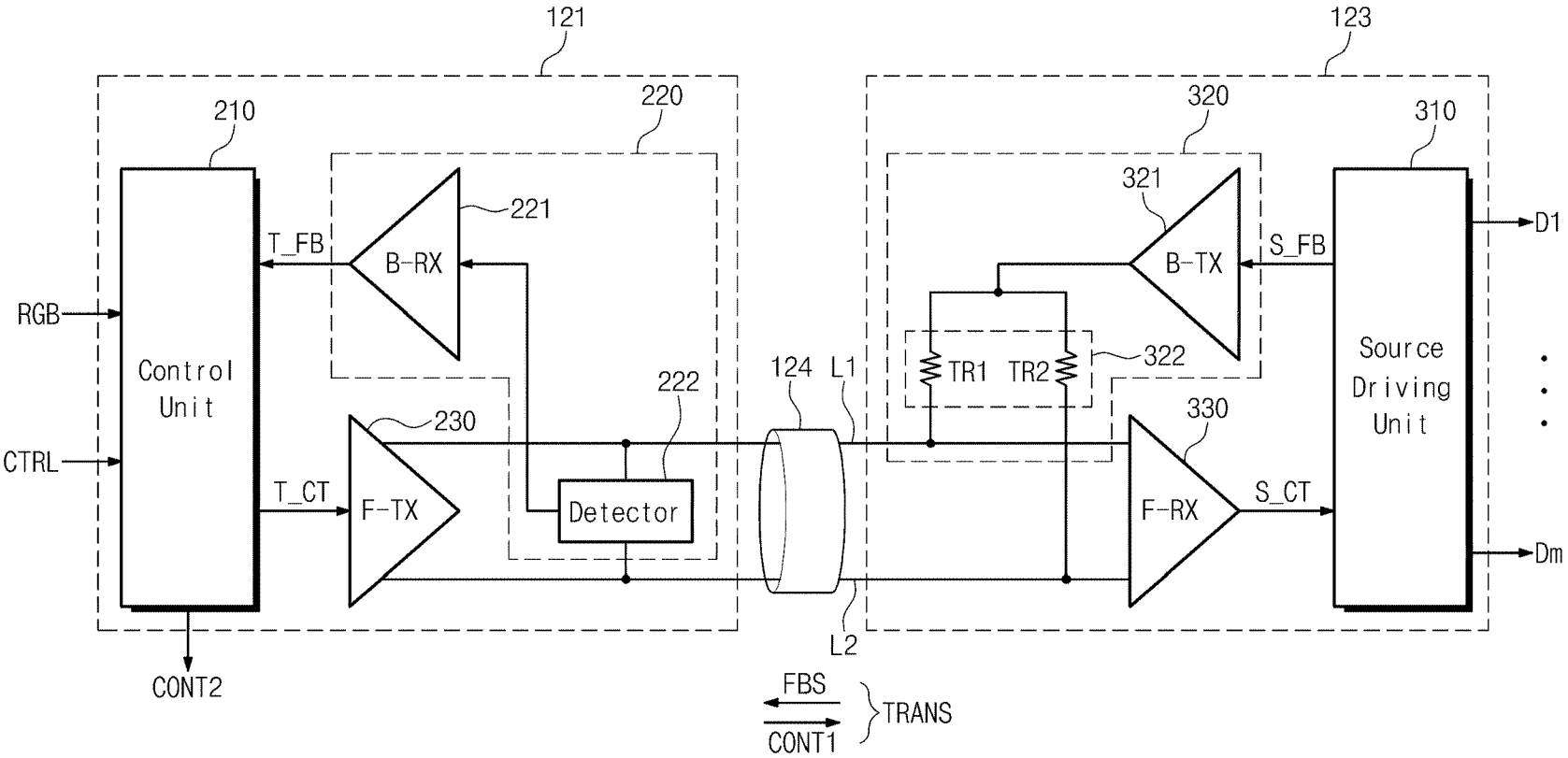
FIG. 2 illustrates configurations of the timing controller and the source driver illustrated in FIG. 1.

FIG. 2 illustrates configurations of the timing controller and the source driver illustrated in FIG. 1.

Referring to FIG. 2, the timing controller 121 may transmit the image control signal CONT1 to the source driver 123 and at the same time may receive the feedback signal FBS. The source driver 123 may transmit the feedback signal FBS to the timing controller 121 and at the same time receive the image control signal CONT1. The duplex communication path 124 may electrically connect the timing controller 121 and the source driver 123 and transmit/receive signals. In particular, the timing controller 121 may detect a voltage level of a signal received through the duplex communication path 124 and recover the feedback signal FBS from the source driver 123 according to the detected voltage level. The duplex communication path 124 includes a first signal line L1 and a second signal line L2, which are electrically connected between the timing controller 121 and the source driver 123. The duplex communication path 124 may transmit a pair of differential signals through the first and second signal lines L1 and L2.

The timing controller 121 includes a control unit 210, a reception circuit 220 and a transmitter F-TX 230. The control unit 210 receives the image signal RGB and the control signal CTRL from the outside and outputs the transmission image control signal T_CT. The control unit 210 may further output a gate control signal CONT2.

The transmitter F-TX 230 converts the transmission image control signal T_CT into the image control signal CONT1, which is transmittable through the duplex communication path 124. In an exemplary embodiment, the transmitter F-TX 230 may convert the transmission image control signal T_CT of a transistor to transistor logic ("TTL") level into the image control signal CONT1 in a differential signaling manner.

The reception circuit 220 detects a voltage level of the feedback signal FBS received through the duplex communication path 124 and recovers a reception feedback signal T_FB according to the detected voltage level. The reception circuit 220 includes a receiver B-RX 221 and a detector 222. The detector 222 detects voltage levels of the first and second signal lines L1 and L2 of the duplex communication path 124. The receiver B-RX 221 recovers the voltage level detected by the detector into the reception feedback signal T_FB and provides the reception feedback signal T_FB to the control unit 210.

The source driver 123 includes a source driving unit 310, a transmission circuit 320, and a receiver F-RX 330. The receiver F-RX 330 converts the image control signal CONT1 received through the duplex communication path 124 into a reception image control signal S_CT. The receiver F-RX 330 may convert the image control signal CONT1 in the differential signal manner into the reception image control signal S_CT of the transistor-transistor logic ("TTL") level.

The source driving unit 310 outputs data signals D1 to Dm for driving the plurality of data lines DL1 to DLm of the display panel 110 illustrated in FIG. 1 in response to the reception image control signal S_CT.

The transmission circuit 320 receives the transmission feedback signal S_FB and outputs the feedback signal FBS to the duplex communication path 124. The transmission circuit 320 includes a transmitter B-TX 321 and a termination resistor circuit 322. The transmitter B-TX 321 outputs the transmission feedback signal S_FB as the feedback signal FBS. In an exemplary embodiment, the feedback signal FBS has a voltage level of a high level (i.e. logic '1') and a low level (i.e. logic '0'), for example.

The termination resistor circuit 322 includes resistors TR1 and TR2. The resistor TR1 is connected between an output terminal of the transmitter B-TX 321 and the first signal line L1. The resistor TR2 is connected between the output terminal of the transmitter B-TX 321 and the second signal line L2.

Figure 3:
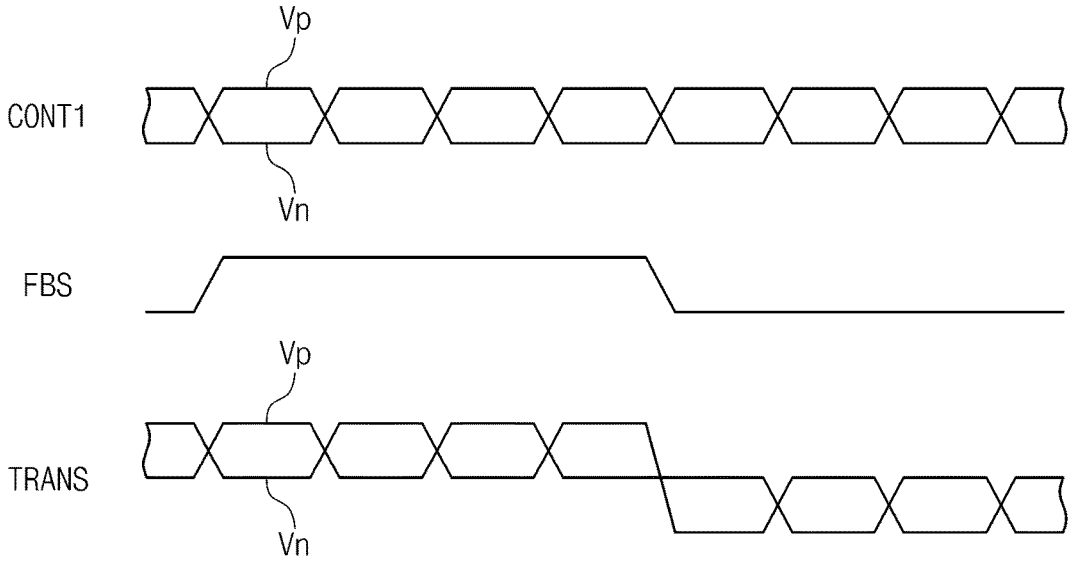
FIG. 3 is a timing diagram exemplarily illustrating signals transmitted through the duplex communication path illustrated in FIG. 2.

FIG. 3 is a timing diagram exemplarily illustrating signals transmitted through the duplex communication path illustrated in FIG. 2.

Referring to FIGS. 2 and 3, the image control signal CONT1 transmitted from the timing controller 121 to the source driver includes a pair of differential signals Vp and Vn. The feedback signal FBS transmitted from the source driver 123 to the timing controller 121 has a voltage level of a high level (i.e. logic '1') and a low level (i.e. logic '0'), for example.

When the timing controller 121 transmits the image control signal CONT1 through the duplex communication path 124 and at the same time the source driver 123 transmits the feedback signal FBS to the duplex communication path 124, a transmission signal TRANS, in which the image control signal CONT1 and the feedback signal FBS are superimposed, is transmitted through the duplex communication path 124. In other words, a signal in a common mode voltage ("VCM") modulation scheme is transmitted through the duplex communication path 124 between the timing controller 121 and the source driver 123.

The detector 222 detects a voltage level of the transmission level transmitted through the first and second signal lines L1 and L2. The receiver B-RX 221 may recover the reception feedback signal T_FB according to the detected voltage level.

Figure 4:
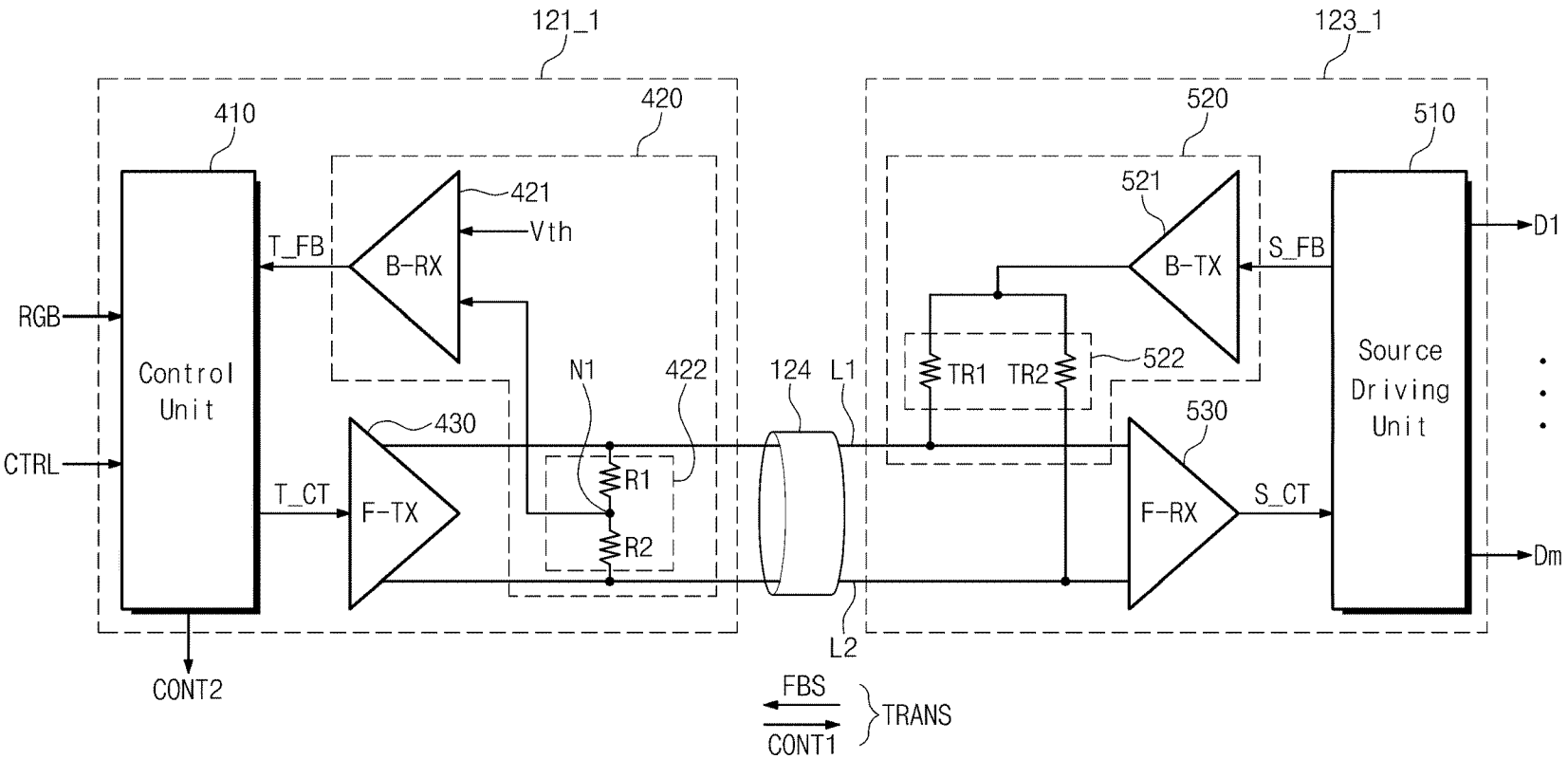
FIG. 4 illustrates another exemplary embodiment of configurations of the timing controller and the source driver illustrated in FIG. 1 according to the invention.

FIG. 4 illustrates exemplary configurations of the timing controller and the source driver illustrated in FIG. 1 according to another exemplary embodiment of the invention.

Referring to FIG. 4, the timing controller 121_1 may transmit the image control signal CONT1 to the source driver 123_1 and at the time receive the feedback signal FBS. The source driver 123_1 may transmit the feedback signal FBS to the timing controller 121 and at the same time receive the image control signal CONT1. The duplex communication path 124 may electrically connect the timing controller 121_1 and the source driver 123_1 and transmit/receive signals. In particular, the timing controller 121_1 may detect a voltage level of a signal received through the duplex communication path 124 and recover the feedback signal FBS from the source driver 123_1 according to the detected voltage level. The duplex communication path 124 includes a first signal line L1 and a second signal line L2, which are electrically connected between the timing controller 121_1 and the source driver 123_1. The duplex communication path 124 may transmit a pair of differential signals through the first and second signal lines L1 and L2.

The timing controller 121_1 includes a control unit 410, a reception circuit 420 and a transmitter F-TX 430. The control unit 410 receives the image signal RGB and the control signal CTRL from the outside and outputs the transmission image control signal T_CT. The control unit 410 may further output a gate control signal CONT2.

The transmitter F-TX 430 converts the transmission image control signal T_CT into the image control signal CONT1, which is transmittable through the duplex communication path 124. In an exemplary embodiment, the transmitter F-TX 430 may convert the transmission image control signal T_CT of a TTL level into the image control signal CONT1 in a differential signaling scheme, for example.

The reception circuit 420 detects a voltage level of the feedback signal FBS received through the duplex communication path 124 and recovers a reception feedback signal T_FB according to the detected voltage level. The reception circuit 420 includes a receiver B-RX 421 and a detector 422. The detector 422 detects voltage levels of the first and second signal lines L1 and L2 of the duplex communication path 124. The detector 422 includes resistors R1 and R2 connected serially between the first and second signal lines L1 and L2. The receiver B-RX 421 compares a voltage of a first node N1 between the resistors R1 and R2 in the detector 422 with a threshold voltage Vth, and recovers the reception feedback signal T_FB according to the comparison result. The reception feedback signal T_FB is provided to the control unit 410.

In the timing diagram illustrated in FIG. 3, while the feedback signal is of a high level, a voltage level of the first node N1, which is determined according to a voltage level of a transmission signal TRANS transmitted through the first and second signal lines L1 and L2 of the duplex communication path 124, is higher than the threshold voltage Vth. When the voltage level of the first node N1 is higher than the threshold voltage Vth, the reception feedback signal T_FB of a high level may be output.

In the timing diagram illustrated in FIG. 3, while the feedback signal is of a low level, a voltage level of the first node N1, which is determined according to a voltage level of a transmission signal TRANS transmitted through the first and second signal lines L1 and L2 of the duplex communication path 124, is lower than the threshold voltage Vth. When the voltage level of the first node N1 is lower than the threshold voltage Vth, the reception feedback signal T_FB of a low level may be output.

The source driver 123_1 includes a source driving unit 510, a transmission circuit 520, and a receiver F-RX 530. The receiver F-RX 530 converts the image control signal CONT1 received through the duplex communication path 124 into a reception image control signal S_CT. The receiver F-RX 530 may convert the image control signal CONT1 in the differential signal manner into the reception image control signal S_CT of the TTL level.

The source driving unit 510 outputs data signals D1 to Dm for driving the plurality of data lines DL1 to DLm of the display panel 110 illustrated in FIG. 1 in response to the reception image control signal S_CT.

The transmission circuit 520 receives the transmission feedback signal S_FB and outputs the feedback signal FBS to the duplex communication path 124. The transmission circuit 520 includes a transmitter B-TX 521 and a termination resistor circuit 522. The transmitter B-TX 521 outputs the transmission feedback signal S_FB as the feedback signal FBS. In an exemplary embodiment, the feedback signal FBS has a voltage level of a high level (i.e. logic '1') and a low level (i.e. logic '0'), for example.

The termination resistor circuit 522 includes resistors TR1 and TR2. The resistor TR1 is connected between an output terminal of the transmitter B-TX 521 and the first signal line L1. The resistor TR2 is connected between the output terminal of the transmitter B-TX 521 and the second signal line L2.

Figure 5:
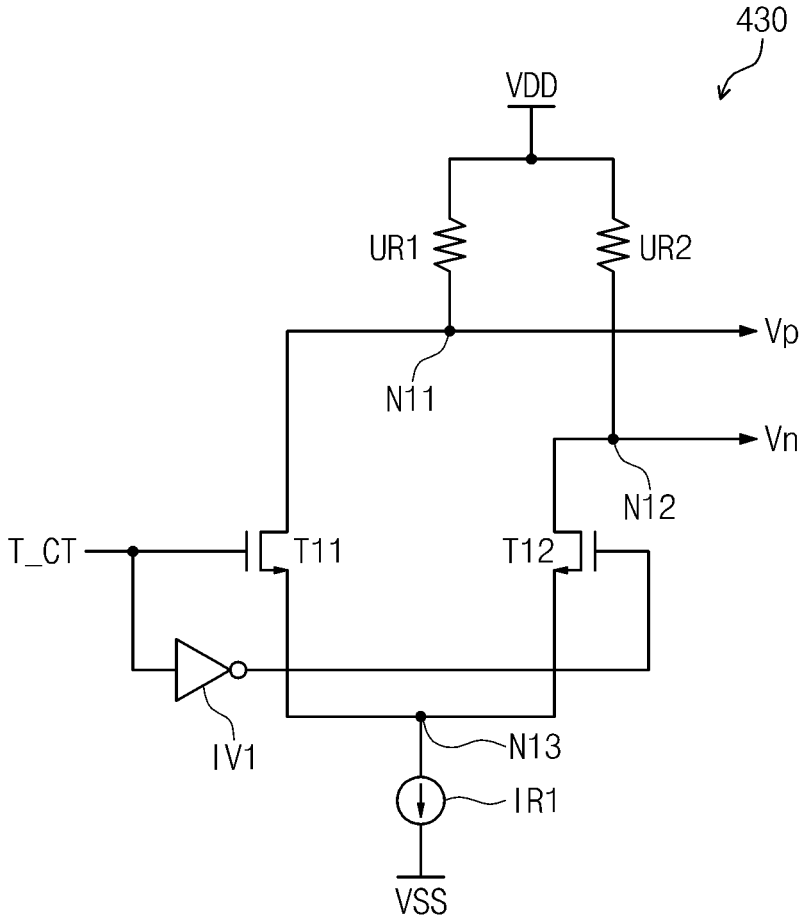
FIG. 5 illustrates an exemplary configuration of the transmitter inside the timing controller illustrated in FIG. 4.

FIG. 5 illustrates an exemplary configuration of the transmitter inside the timing controller illustrated in FIG. 4.

Referring to FIG. 5, the transmitter 430 includes transistors T11 and T12, pull-up resistors UR1 and UR2, an inverter IV1, and a current source IR1.

The pull-up resistor UR1 is connected between a power source voltage VDD and a node N11. The pull-up resistor UR2 is connected between the power source voltage VDD and a node N12. The transistor T11 includes a first electrode connected to the node N11, a second electrode connected to the node N13, and a control electrode connected to the transmission image control signal T_CT. The inverter IV1 includes an input terminal for receiving the transmission image control signal T_CT and an output terminal. The transistor T12 includes a first electrode connected to the node N12, a second electrode connected to the node N13, and a control electrode connected to an output terminal of the inverter IV1. The current source IR1 is connected between the node N13 and a ground voltage VSS. Signals of the first and second nodes N11 and N12 are output as a pair of differential signals Vp and Vn.

The transmitter 430 including such a configuration may output a pair of differential signals Vp and Vn having complementary voltage levels according to a voltage level of the transmission image control signal T_CT. The pair of differential signals Vp and Vn may be transmitted to the source driver 123_1 through the first and second lines L1 and L2 of the duplex communication path 124 illustrated in FIG. 4.

Figure 6:
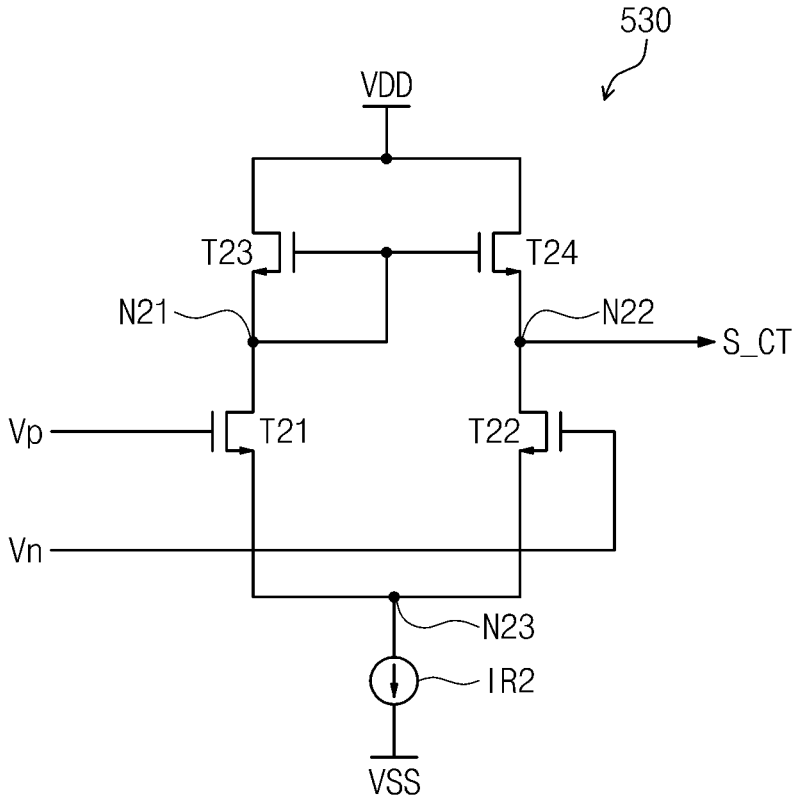
FIG. 6 illustrates an exemplary configuration of the receiver inside the source driver illustrated in FIG. 4.

FIG. 6 illustrates an exemplary configuration of the receiver inside the source driver illustrated in FIG. 4.

Referring to FIG. 6, the receiver 530 includes transistors T21, T22, T23, and T24, and a current source IR2. The transistor T21 includes a first electrode connected to a node N21, a second electrode connected to a node N23, and a control electrode connected to a differential signal Vp. The transistor T22 includes a first electrode connected to a node N22, a second electrode connected to the node N23, and a control electrode connected to a differential signal Vn.

The transistor T23 includes a first electrode connected to a power source voltage VDD, a second electrode connected to the node N21, and a control electrode connected to the node N21. The transistor T24 includes a first electrode connected to the power source voltage VDD, a second electrode connected to the node N22, and a control electrode connected to the control electrode of the transistor T23 connected to the node N21. The current source IR2 is connected between the node N23 and a ground voltage VSS.

The receiver 530 having such a configuration outputs a reception image control signal S_CT according to a voltage difference of the pair of differential signals Vp and Vn, which are received through the first and second signal lines L1 and L2 of the duplex communication path 124 illustrated in FIG. 4. The reception image control signal S_CT is provided to the source driving unit 510 (refer to FIG. 4).

Figure 7:
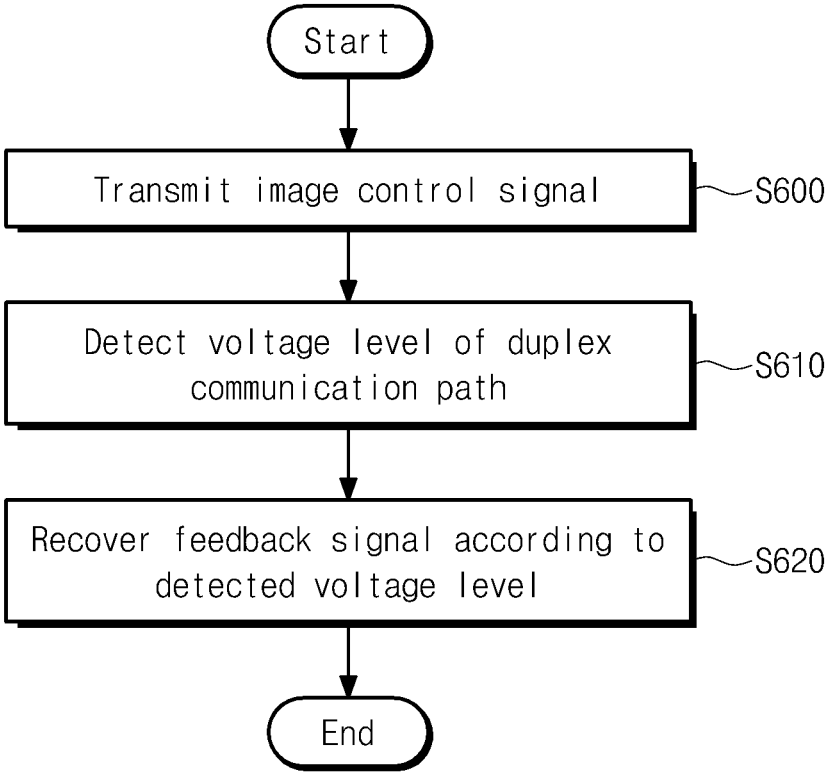
FIG. 7 is a flowchart illustrating a duplex communication method of the timing controller illustrated in FIG. 4.

FIG. 7 is a flowchart illustrating a duplex communication method of the timing controller illustrated in FIG. 4.

Referring to FIGS. 4 and 7, the control unit 410 inside the timing controller 121_1 receives the image signal RGB and the control signal CTRL from the outside and outputs the transmission image control signal T_CT.

The transmitter 430 converts the transmission image control signal T_CT into the image control signal CONT1 and transmits the image control signal CONT1 to the duplex communication path 124 (operation S600).

The reception circuit 420 detects a voltage level of a feedback signal FBS received through the duplex communication path 124 (operation S610). The detector 422 may detect voltage levels of the pair of differential signals Vp and Vn (refer to FIG. 3) received through first and second signal lines L1 and L2 on the duplex communication path 124.

The receiver 421 compares the detected voltage level of the first node N1 between the resistors R1 and R2 in the detector 422 with a threshold voltage Vth, and recovers the reception feedback signal T_FB according to the comparison result (operation S620). In an exemplary embodiment, when the voltage level of the first node N1 is higher than the threshold voltage Vth, the receiver 421 outputs the reception feedback signal T_FB of a high level, for example. When the voltage level of the first node N1 is lower than the threshold voltage Vth, the receiver 421 outputs the reception feedback signal T_FB of a low level.

The timing controller 121_1 may perform duplex communication with the source driver 123-1. In other words, through the duplex communication path 124, the image control signal CONT1_ may be transmitted from the timing controller 121_1 to the source driver 123_1 and the feedback signal FBS may be transmitted from the source driver 123-1 to the timing controller 121-1.

A timing controller of a display device having the above-described configuration may perform duplex communication with a source driver. In other words, an image control signal may be transmitted from a timing controller to a source driver and at the same time, a feedback signal may be transmitted from the source driver to the timing controller through one communication path.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display device comprising:

a timing controller which transmits an image control signal and at a same time receives a feedback signal;

a source driver which transmits the feedback signal and receives the image control signal; and a duplex communication path between the timing controller and the source driver, wherein the timing controller detects a voltage level of a signal received through the duplex communication path and recovers the feedback signal according to the detected voltage level, and wherein the image control signal and the feedback signal are superimposed and transmitted through the duplex communication path at the same time.

2. The display device of claim 1, wherein the timing controller comprises:

a control unit which receives an image signal and a control signal from an outside, and outputs the image control signal;

a transmitter which transmits the image control signal to the duplex communication path; and a reception circuit which recovers the feedback signal according to the detected voltage level.

3. The display device of claim 2, wherein the duplex communication path comprises first and second signal lines for differential signal transmission.

4. The display device of claim 3, wherein the reception circuit comprises:

a voltage detector which is connected to the first and second signal lines, and detects voltage levels of signals received through the first and second signal lines; and a receiver which recovers the feedback signal according to the detected voltage levels.

5. The display device of claim 3, wherein the reception circuit comprises:

a voltage detector comprising a plurality of resistors connected between the first and second signal lines; and a receiver which compares a voltage of a first node between the plurality of resistors and a threshold voltage, and recovers the feedback signal according to a compared result.

6. The display device of claim 5, wherein the receiver recovers the feedback signal into a first voltage level when the voltage of the first node has a higher level than that of the threshold voltage, and recovers the feedback signal into a second voltage level when the voltage of the first node has a lower level than that of the threshold voltage.

7. The display device of claim 1, wherein the source driver comprises:

a receiver which receives the image control signal through the duplex communication path;

a source driving unit which drives a plurality of data lines in response to the image control signal received through the receiver, and outputs the feedback signal; and a transmission circuit which transmits the feedback signal to the duplex communication path.

8. The display device of claim 7, wherein the transmission circuit comprises:

a transmitter which transmits the feedback signal to the duplex communication path; and a termination resistor circuit connected between an output terminal of the transmitter and the duplex communication path.

9. The display device of claim 1, further comprising:

a display panel comprising a plurality of pixels respectively connected to a plurality of gate lines and a plurality of data lines; and a gate driver which drives the plurality of gate lines;

wherein the source driver drives the plurality of data lines in response to the image control signal.

10. A duplex communication method of a timing controller, the duplex communication method comprising:

transmitting an image control signal to a source driver and receiving a feedback signal from the source driver at the same time by the timing controller through a duplex communication path;

detecting a voltage level of a signal received through the duplex communication path by the timing controller; and recovering the feedback signal transmitted from the source driver according to the detected voltage level, wherein the image control signal and the feedback signal are superimposed and transmitted through the duplex communication path at a same time.

11. The duplex communication method of claim 10, wherein the duplex communication path is connected to first and second signal lines, and the detecting the voltage level comprises detecting voltage levels of signals received through the first and second signal lines.

12. The duplex communication method of claim 11, wherein the detecting the voltage level further comprises:

comparing the detected voltage level with a threshold voltage;

recovering the feedback signal into a first voltage level, when the detected voltage level is higher than the threshold voltage; and recovering the feedback signal into a second voltage level, when the detected voltage level is lower than the threshold voltage.

* * * * *